United States Patent [19]

Sonobe et al.

[11] Patent Number: 4,931,744

[45] Date of Patent: Jun. 5, 1990

[54] SYNCHROTRON RADIATION SOURCE AND METHOD OF MAKING THE SAME

[75] Inventors: Tadasi Sonobe, Iwaki; Shinjiro Ueda, Abiko; Takashi Ikeguchi, Hitachi; Manabu Matsumoto, Higashiibaraki; Kazuo Kuroishi, Hitachi, all of Japan

[73] Assignees: Hitachi, Ltd., Tokyo; Hitachi Service Engineering, Ltd., Ibaraki, both of Japan

[21] Appl. No.: 265,702

[22] Filed: Nov. 1, 1988

[30] Foreign Application Priority Data

Nov. 2, 1987 [JP] Japan ..... 62-275753

[51] Int. Cl.[5] ..... H05H 13/04; H01J 9/00

[52] U.S. Cl. ..... 328/235; 313/24; 313/36; 445/23

[58] Field of Search ..... 313/235, 12, 22, 24, 313/32, 35, 36; 445/23, 22

[56] References Cited

U.S. PATENT DOCUMENTS

| | | | |
|---|---|---|---|
| 3,323,088 | 5/1967 | Lambertson | 328/235 X |
| 4,751,470 | 6/1988 | Ikegami et al. | 328/233 |
| 4,808,941 | 2/1989 | Marsing | 328/235 |

FOREIGN PATENT DOCUMENTS 265797 11/1988 European Pat. Off. .

3703938 10/1987 Fed. Rep. of Germany .

OTHER PUBLICATIONS

The Ultra-High-Vacuum System for the Desy Electron-Position Double Storage Ring "DORIS", by Falland et al., Japanese Journal of Applied Physics, pp. 209-216, 12/1974.

IEEE Transactions on Nuclear Science, *Proposal for Synchrotron Light Source,* Teng, vol. NS-32, No. 5, Oct. 1985, pp. 3354-3358.

*Primary Examiner*—Kenneth Wieder

*Attorney, Agent, or Firm*—Antonelli, Terry, Stout & Kraus

[57] ABSTRACT

A synchrotron radiation source and a method of making the same. As assembly of a beam absorber for absorbing synchrotron radiation beams and a piping for cooling the beam absorber is mounted in a charged particle beam duct of a bending section of the synchrotron radiation source for bending a charged particle beam. Fixed to at least one straight duct that is connectable to either of the opposite ends of the charged particle beam duch is a piping guide duct through which the beam absorber cooling piping is drawn to the outside, so that the assembly of the beam absorber and the beam absorber cooling piping can readily be mounted in the synchrotron radiation source.

9 Claims, 4 Drawing Sheets

SYNCHROTRON RADIATION SOURCE AND METHOD OF MAKING THE SAME

BACKGROUND OF THE INVENTION

This invention relates to a synchrotron radiation (SR) source and a method of making the same, and more particularly relates to an SR source of the type having a beam absorber for absorbing SR beams provided in a charged particle beam duct of a charged particle beam bending section and a method of making the same.

The orbit of a charged particle beam is deflected inside the charged particle beam duct of the bending section to cause the charged particle beam to radiate an SR beam and the interior of the charged particle beam duct must be maintained in a vacuum condition to minimize the loss of charged particles due to its collision with other different particles.

However, when the SR beam directly irradiates the wall of the charged particle beam duct, the irradiated portion, conventionally made of stainless steel or aluminum alloy, undergoes a photo-excited reaction to discharge a large amount of gas and as a result the interior of the charged particle beam duct can not be maintained in a high vacuum condition.

The amount of discharged gas is very large, measuring 10 times to 100 times the amount of gas outgoing merely owing to thermal desorption. It has been envisioned to suppress the gas discharge by providing a beam absorber at a portion, where the SR is irradiated, of the interior wall of the charged particle beam duct. More specifically, the beam absorber is made of a material which has a low photo-excited gas discharge coefficient so that the amount of gas discharged from the surface and interior of the material by a photo-excited reaction concomitant with SR irradiation is small, the beam absorber being used to suppress the generation of gas. Conventionally, as discussed in IEEE, Transactions on Nuclear Science Vol. NS-32, NO. 5, Oct. 1985, pp. 3354–3358, a beam absorber having a linear or approximately linear form is mounted in a charged particle beam duct by being inserted thereinto through an insertion port dedicated to the beam absorber and which is formed in the outer circumstantial wall of the charged particle beam duct.

The mount structure for the beam absorber described in the above literature is well adapted for relatively large-scale SR sources in which the radius of curvature of the charged particle beam duct of the charged particle beam bending section is large and sufficient room is provided.

The prior art pertains therefore to technology of large-scale SR sources and fails to take small-scale SR courses into account.

Should the conventional mount structure for the linear or approximately linear beam absorber be applied to small-scale SR sources in which the radius of curvature of a bending section is small, the curvature of a charged particle beam duct of the bending section is large and the linear beam absorber could not cover or profile the overall circumference of the bending section of large curvature, with the result that there remain portions on the interior wall of the charged particle beam duct which are irradiated directly with the SR. To solve this problem, a number of insertion ports dedicated to beam absorbers have to be provided over the overall circumference of the bending section. However, because of the need to provide the bending section with SR beam lines for guiding SR beams, there is almost no room for the provision of dedicated insertion ports over the overall circumference of the bending section.

Accordingly, the conventional mount structure for the linear beam absorber is totally unsuited for application to small-scale SR sources.

SUMMARY OF THE INVENTION

A major object of the invention is to provide a small-scale SR source which can facilitate mounting of a beam absorber.

Another object of the invention is to provide a method of making the above-mentioned SR source.

According to one aspect of the invention, there is provided an SR source comprising a bending section for bending a charged particle beam having a substantially sectoral or semi-circular charged particle beam duct mounted with a beam absorber and a piping for cooling the beam absorber, and a piping guide duct, fixed to at least one straight duct connectable to one of the ends of the charged particle beam duct, for guiding the beam absorber cooling piping to the outside.

According to another aspect of the invention, there is provided a method by which when mounting a beam absorber and a piping for cooling the beam absorber in a substantially sectoral or semi-circular charged particle beam duct of a charged particle beam bending section, end portions of the beam absorber, which has previously been made to be arcuate, and beam absorber cooling piping are inserted in an opening of one end of the charged particle beam duct, the beam absorber and beam absorber cooling piping are moved along the charged particle beam duct and located at a predetermined position in the charged particle beam duct, an opposite end portion of the beam absorber cooling piping extending beyond the one end of the charged particle beam duct is bent, the bent end portion of the beam absorber cooling piping is drawn through a piping guide duct fixed to a straight duct so as to be mounted therein and the straight duct is connected to the one end of the charged particle beam duct.

By drawing the beam absorber cooling piping through the piping guide duct fixed to the straight duct, the beam absorber can be mounted easily in the charged particle beam duct even in the case of small-scale SR sources.

BRIEF DESCRIPTION OF THE DRAWINGS

Preferred embodiments of the present invention will now be described in conjunction with the accompanying drawings, in which.

DESCRIPTION OF THE PREFERRED EMBODIMENTS

Figure 1:
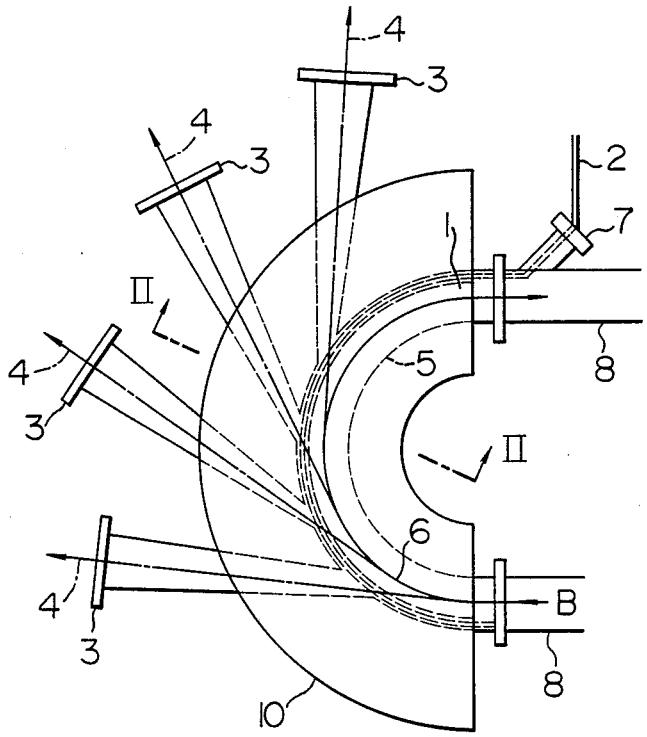
FIG. 1 is a plan view illustrating a first embodiment of an SR source according to the invention.
Figure 2:
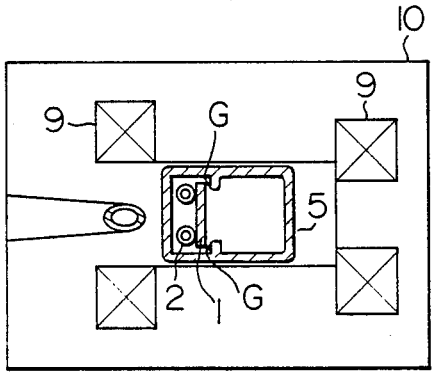
FIG. 2 is a sectional view taken on the line II—II of FIG. 1.

Referring now to FIGS. 1 and 2, a first embodiment of an SR source according to the invention will be described. As shown in FIGS. 1 and 2, the SR source has a semi-circular, approximately C-shaped bending section 10 for bending a charged particle beam B. Referring particularly to FIG. 1, the charged particle beam B travelling on an orbit 6 of the charged particle beam at a straight duct 8 enters an opening of one end of a charged particle beam duct 5, passes through the charged particle beam duct 5 and leaves the other end thereof. The charged particle beam duct 5 of the bending section 10 is encompassed by a bending electromagnet 9, as particularly shown in FIG. 2, and the orbit of the charged particle beam is deflected by the flux of a magnetic field generated by the bending electromagnet 9 to cause the charged particle beam tracing the deflected orbit to radiate an SR beam 4 which is taken out of the source through an SR guide duct 3. Mounted in the charged particle beam duct 5 are a beam absorber 1 and a piping 2 for cooling the beam absorber. The beam absorber 1 is adapted to suppress the generation of gas caused by irradiation of SR beams. The beam absorber cooling piping 2 is drawn to the outside through a piping guide duct 7 which is fixed to a straight duct 8 at a predetermined angle with respect to the charged particle beam orbit 6 so as to jut obliquely outwardly therefrom and the piping 2 is connected at its tip to a heat exchanger, not shown. Since the interior of the charged particle beam duct 5 must be maintained in a vacuum, condition the beam absorber cooling piping 2 is fixed in an airtight manner to the end of the piping guide duct 7 by welding. The charged particle beam duct 5 has a channel G through which the beam absorber 1 and beam absorber cooling piping 2 are guided. The beam absorber 1 and beam absorber cooling piping 2 received in the channel G are immune to mechanical shock or vibration. A separate beam absorber 1 and beam absorber cooling piping 2 may be put together by brazing or welding, or alternatively, a unitary assembly of the beam absorber 1 and the beam absorber cooling piping 2 may originally be prepared.

Figure 3:
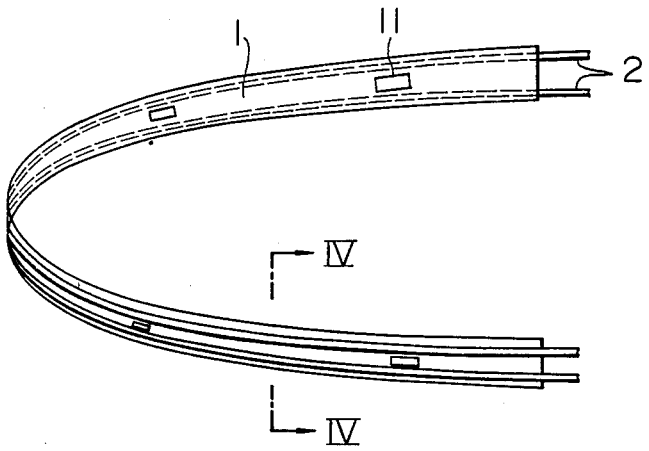
FIG. 3 is a perspective view illustrating a beam absorber and a beam absorber cooling piping used in the SR source of FIG. 1.

The overall construction of the beam absorber 1 and beam absorber cooling piping 2 used in the bending section 10 of the SR source of FIG. 1 is illustrated in FIG. 3. SR beam guide ports or windows 11 are formed in the beam absorber 1 shown in FIG. 3.

The beam absorber 1 is preferably made of a material having a low photo-excited gas discharge coefficient which can discharge a small amount of gas under irradiation of light or photons, preferably, less than $10^{-6}$ molecules/photon for the purpose of the present invention. As the low photo-excited gas discharge coefficient material, a single crystalline material having a high purity of 99.99% or more, for example, high-purity copper or aluminum, may be used.

Figure 4:
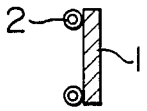
FIG. 4 is a sectional view taken on the line IV—IV of FIG. 3.

Typically, the beam absorber 1 and beam absorber cooling piping 2 shown in FIG. 3 are formed as a unitary assembly which has a sectional form as shown in FIG. 4.

With the construction of the present embodiment described previously, since the beam absorber cooling piping 2 can be drawn through the piping guide duct 7 fixed to the straight duct 8 regardless of the magnitude of the radius of curvature of charged particle beam duct 5 in the bending section, an excellent effect results in that the beam absorber 1 can readily be mounted in the charged particle beam duct 5 even in the case of small-scale SR sources.

Figure 5:
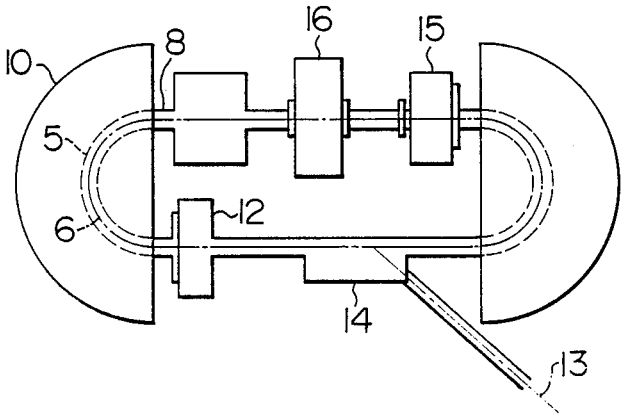
FIG. 5 is a schematic diagram showing the overall construction of a small-scale SR source incorporating the invention.

FIG. 5 is a schematic showing the overall construction of a small-scale SR source incorporating the present invention.

Referring to FIG. 5, a charged particle 13 injected into an electronic input system 14 moves along the charged particle beam orbit 6 set up in the charged particle beam duct 5. The movement of the charged particle along the orbit 6 of the charged particle beam is controlled by means of control system 12, acceleration control system 16 and orbit adjustment magnet 15 and, as described previously, the charged particle radiates an SR beam while passing through the bending section 10.

Figure 7:
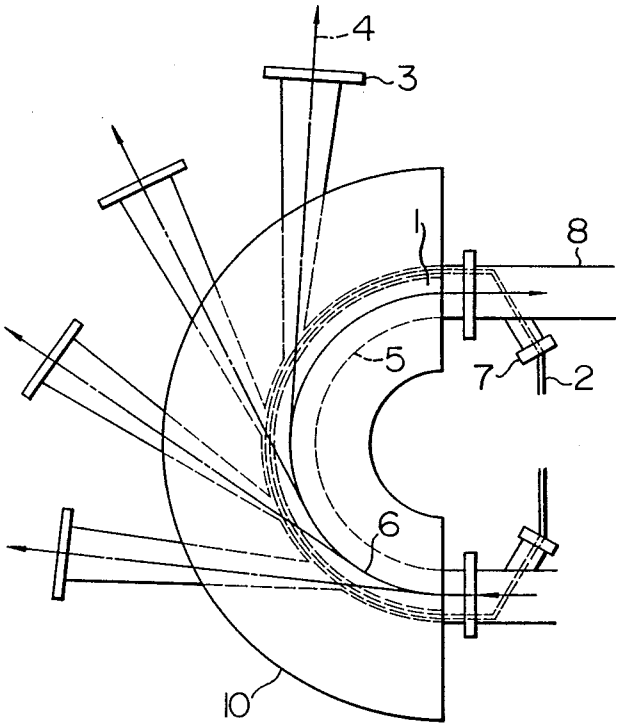
FIG. 7 is a plan view illustrating a third embodiment of an SR source according to the invention.
Figure 6:
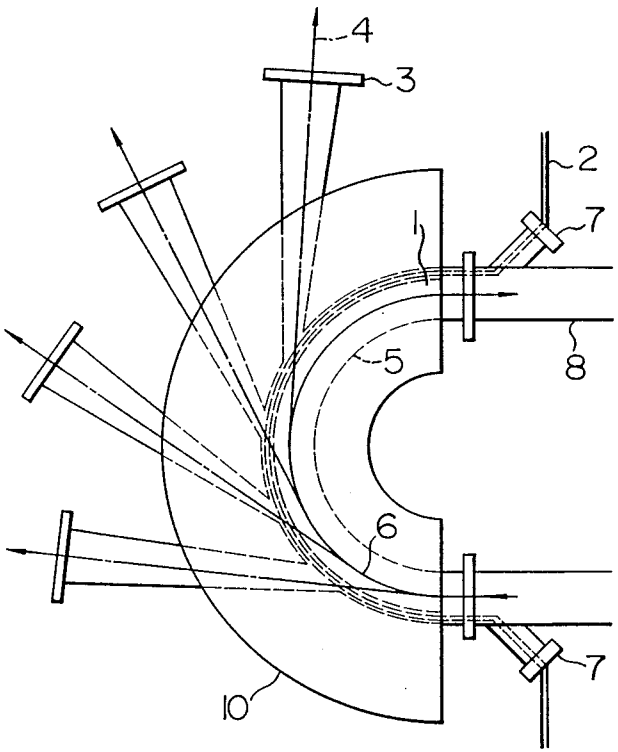
FIG. 6 is a plan view illustrating a second embodiment of an SR source according to the invention.

Other embodiments of the invention are illustrated in FIGS. 6 and 7. Referring particularly to FIG. 6, there is illustrated a second embodiment of an SR source wherein piping guide ducts 7 are provided to the straight ducts 8 which are connectable to the opposite ends of the charged particle beam duct 5. As in the first embodiment, each piping guide duct 7 forms a predetermined angle with respect to the charged particle beam orbit 6 to jut obliquely outwardly therefrom. Advantageously, in accordance with this embodiment, halves of an assembly of beam absorber 1 and cooling piping 2 therefor can be inserted independently into the opposite ends of the charged particle beam duct to complete the same assembly as that of the first embodiment directed to the insertion into one end of the charged particle beam duct. In a third embodiment, piping guide ducts 7 are provided to straight ducts which are connectable to the opposite ends of the charged particle beam duct 5, as in the case of the FIG. 6 embodiment, but each piping guide duct 7 forms a predetermined angle with respect to the charged particle beam orbit 6 to jut obliquely inwardly therefrom so as to achieve the existing positional relationship of the source to peripheral equipment.

Obviously, the FIG. 7 embodiment may be modified such that a piping guide duct 7 is provided for only one end of the charged particle beam duct 5.

A method of making the SR source described previously, and more specifically, a method of mounting the assembly of the beam absorber 1 and beam absorber cooling piping 2 in the charged particle beam duct 5 will be described with reference to FIGS. 8, 9 and 10.

Figure 8:
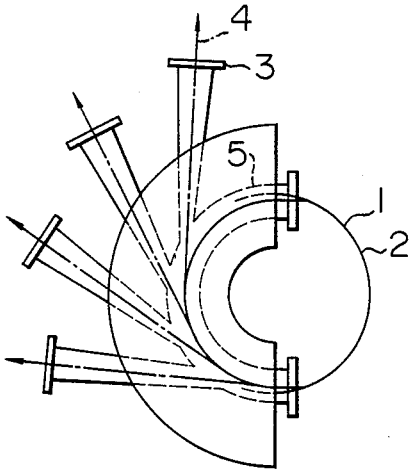
FIGS. 8, 9 and 10 are plan views showing the step sequence of mounting the beam absorber in accordance with the invention.

(1) First of all, as shown in FIG. 8, the opposite end portions of the arcuate beam absorber 1 are respectively inserted into the opposite end openings of the charged particle beam duct 5.

Figure 9:
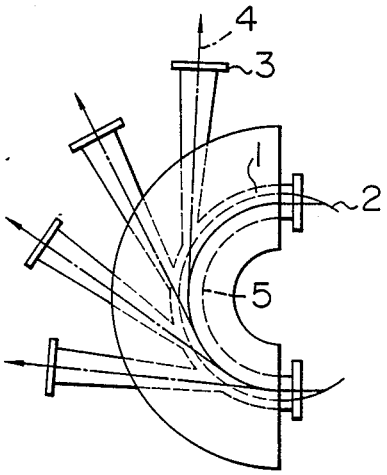

(2) Subsequently, as shown in FIG. 9, the beam absorber 1 is moved around the circumference of the charged particle beam duct and located at a predetermined position in the charged particle beam duct.

Figure 10:
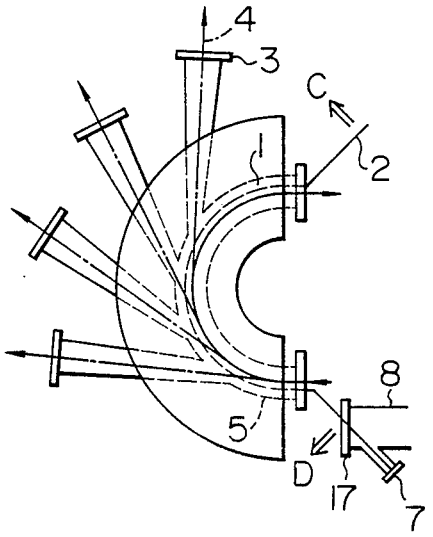

(3) Finally, as shown in FIG. 10, the opposite end portions of beam absorber cooling piping 2 extending beyond the opposite ends of the charged particle beam duct 5 are bent outwardly in the direction of arrows C and D, respectively, with the bent portions drawn through the piping guide ducts 7 fixed to straight ducts 8, and the straight ducts 8 are connected to the charged particle beam duct 5. In order to maintain airtight condition of the charged particle beam duct, the connection of the straight ducts 8 to charged particle beam duct 5 and the fixing of beam absorber cooling piping 2 to piping guide duct 7 are carried out by an airtight welding process.

Vacuum pumps required for evacuating the charged particle beam duct 5 may be placed inside the bending section 10 or may be connected to the straight ducts 8.

As described above, according to the invention, an SR source is provided which includes a bending section for bending a charged particle beam having a substantially sectoral or semi-circular charged particle beam duct mounted with a beam absorber and a piping for cooling the beam absorber, and a piping guide duct, fixed to at least one straight duct which is connectable to one of the ends of the charged particle beam duct, for guiding the beam absorber cooling piping to the outside. Furthermore, according to the invention a method of making an SR source is provided wherein, when mounting the beam absorber and the beam absorber cooling piping in the substantially sectoral or semi-circular charged particle beam duct of the bending section, end portions of the beam absorber, which has previously been made to be arcuate, and beam absorber cooling piping are inserted in an opening of one end of the charged particle beam duct, the beam absorber and the beam absorber cooling piping are moved along the charged particle beam duct and located at a predetermined position in the charged particle beam duct, an opposite end portion of the beam absorber cooling piping extending beyond the one end of the charged particle beam duct is bent, the bent end portion of the beam absorber cooling piping is drawn through a piping guide duct fixed to a straight duct so as to be mounted therein, and the straight duct is connected to the one end of the charged particle beam duct. Therefore, advantageously, the beam absorber cooling piping can be drawn through the piping guide duct fixed to the straight duct and hence the beam absorber can be mounted easily in the charged particle beam duct even in the case where the SR source is a small-scale SR source.

We claim:

1. A synchrotron radiation source comprising:

a semi-circular charged particle beam bending section;

a semi-circular charged particle beam duct located inside said bending section and providing an orbital path for an orbiting charged particle beam, said charged particle beam duct having a beam absorber and a beam absorber cooling piping for cooling the beam absorber mounted therein;

a bending electromagnet, encompassing said charged particle beam duct, for generating a magnetic field which deflects the orbit of a charged particle beam inside said charged particle beam duct;

straight ducts connected to opposite ends of said charged particle beam duct; and a piping guide duct fixed to at least one of said straight ducts and through which said beam absorber cooling piping can be drawn out of said synchrotron radiation source.

2. A synchrotron radiation source according to claim 1 wherein piping guide ducts are respectively fixed to said straight ducts connected to the opposite ends of said charged particle beam duct.

3. A synchrotron radiation source according to claim 1, wherein said piping guide duct forms a predetermined oblique angle with respect to said orbital path and juts away from the center of said orbital path.

4. A synchrotron radiation source according to claim 1, wherein said piping guide duct forms a predetermined oblique angle with respect to said orbital path and juts toward the center of said orbital path.

5. A synchrotron radiation source according to claim 1 wherein said charged particle beam duct has a channel (G) through which said beam absorber and beam absorber cooling piping are guided.

6. A synchrotron radiation source according to claim 2, wherein each of said piping guide ducts forms a predetermined oblique angle with respect to said orbital path and juts away from the center of said orbital path.

7. A synchrotron radiation source according to claim 2, wherein each of said piping guide ducts forms a predetermined oblique angle with respect to said orbital path and juts toward the center of said orbital path.

8. A synchrotron radiation source according to claim 2 wherein said charged particle beam duct has a channel (G) through which said beam absorber and beam absorber cooling piping are guided.

9. A method of making a synchrotron radiation source comprising a bending section, for bending a charged particle beam, having a substantially semicircular charged particle beam duct, a beam absorber and a beam absorber cooling piping for cooling the beam absorber mounted within said charged particle beam duct, a bending electromagnet encompassing said charged particle beam duct for generating a magnetic field which deflects the orbit of a charged particle beam inside said charged particle beam duct, and straight ducts connected to opposite ends of said charged particle beam duct, said method comprising the steps of:

inserting opposite end portions of said beam absorber, which has previously been made to be arcuate, and opposite end portions of said beam absorber cooling piping into openings of the opposite ends of said charged particle beam duct;

moving said beam absorber and beam absorber cooling piping along said charged particle beam duct and locating said beam absorber and beam absorber cooling piping at a predetermined position in said charged particle beam duct;

bending the opposite end portions of said beam absorber cooling piping extending beyond the opposite ends of said charged particle beam duct;

drawing the bent end portions of said beam absorber cooling piping through piping guide ducts fixed to said straight ducts so that the bent end portions are mounted in said straight ducts; and connecting said straight ducts to said charged particle beam duct.

* * * * *